United States Patent [19]

Dwinnell

[11] Patent Number: 4,949,810

[45] Date of Patent: Aug. 21, 1990

[54] ATTACHMENT TO STABILIZE AND EXPAND THE USE OF HOLLOW RUNG LADDERS

[76] Inventor: Wayne F. Dwinnell, 530 Old Petersen Road, Campbell River, British Columbia, Canada, V9W 3M9

[21] Appl. No.: 251,771

[22] Filed: Oct. 3, 1988

[51] Int. Cl.[5] ..... E06C 7/48; E06C 7/16

[52] U.S. Cl. ..... 182/214; 182/107; 182/117; 248/238

[58] Field of Search ..... 182/214, 107, 117; 248/238

[56] References Cited

U.S. PATENT DOCUMENTS

| | | | |
|---|---|---|---|
| 2,871,067 | 1/1959 | Brogdon | 182/121 |
| 3,059,723 | 10/1962 | Shore | 182/107 |
| 3,792,750 | 2/1974 | Madison | 182/214 |

FOREIGN PATENT DOCUMENTS

| | | | |
|---|---|---|---|
| 81404 | 6/1983 | European Pat. Off. | 182/214 |

*Primary Examiner*—Reinaldo P. Machado

[57] ABSTRACT

A pair of attachments for use with ladders constructed with hollow rungs to stabilize the ladder and to protect the gutter. These attachments when used with ladders also provide for a scaffold plank. The attachments when used with a ladder on a pitched roof allows the ladder to be used to access that roofs peak. Previously the ladder would rest on the rain gutter when the user was to access the roof of a building. Previously a work platform had to be built from wood or metal resulting in time consuming construction. Previously when accessing the roof peak of a building a means of providing a positive foothold had to be constructed from rope and ladder or from wood. The present invention provides steel flat bars bent to fit the rung spacing of the ladder with a steel tube welded at each end sized to fit snuggly into the opening of any two consecutive rungs in that ladder. The ladder can now be used to access the roof of a building without resting on the gutter. The ladder can be used as part of a scaffold and to provide a positive foothold when on a pitched roof.

1 Claim, 1-Drawing Sheet

ATTACHMENT TO STABILIZE AND EXPAND THE USE OF HOLLOW RUNG LADDERS

BACKGROUND OF THE INVENTION

The invention relates to the field of ladders and scaffolds. More particularly, the invention relates to expanding the use of a ladder. Ladders are used extensively in and about the home and in industry. Many users for example use the ladder to access the roof of a building. The ladder is also used to gain access to the side of a building. Currently when the ladder is used to access the roof of that building it in many cases must rest on the rain gutter. Currently when on the roof the user usually relies on his foot wear for his footing. Currently when a platform is required for a work project it must be fabricated from material brought into the work area in place of the ladder already present.

The ladder related to this invention is a ladder fabricated from aluminum with hollow rungs. It is apparent that when the ladder is rested on the light weight aluminum or vinyl gutter, that rain gutter presents both a smooth surface for which the ladder to slide off as well as weak construction for support of the ladder and its load. When working on a pitched roof the surface may be slippery due to snow, ice or rain. It may afford poor footing by virtue of its steep pitch or construction material. Many jobs are attempted from a poor platform because the building of a suitable platform is considered to large a task for the job at hand. Many people have fallen with ladders unsecured, from roofs affording poor footing and from make-shift platform, to serious injury. The problem is particularly prominent around the home where the user is unaware of the dangers involved with the use of a ladder and where in many cases safety is left to chance for lack of a convenient safety device.

SUMMARY OF THE INVENTION

The present invention provides for a set of attachments to fit into the ladder allowing part of the load placed on the ladder to be transfered to the roof over the gutter thus protecting the gutter and stabilizing the ladder. The present invention allows the ladder to become part of a scaffold. The present invention allows the ladder to be used as a positive foothold when on the pitched roof of a building. It comprises a set of flatbars bent through a radius to an angle with tubing welded at right angles at either end allowing these brackets to fit into ladders with hollow rungs.

BRIEF DESCRIPTION OF THE DRAWINGS

Referring specifically to the drawings in which like numerals in which like numerals refer to like parts, numeral 1 is a conventional ladder with hollow rungs 2.

Figure 1:
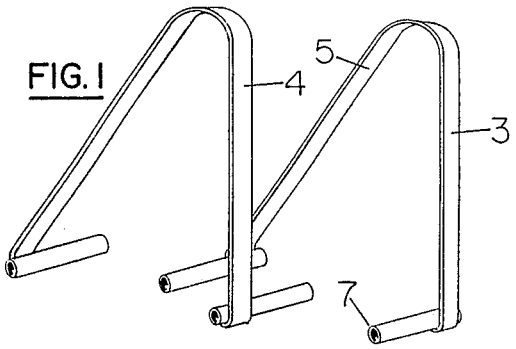
FIG. 1 is a perspective view of my invention showing the components of the invention.
Figure 2:
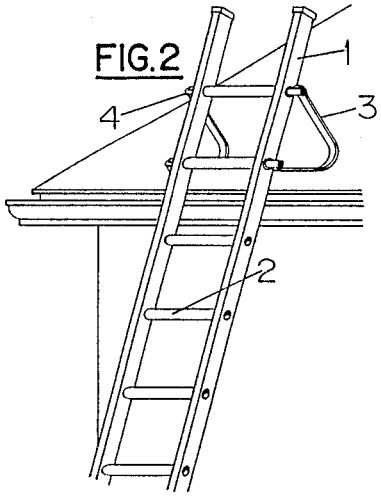
FIG. 2 is a perspective view of my the ladder showing my invention in place to stabilize the ladder on the roof over and away from the gutter.
Figure 3:
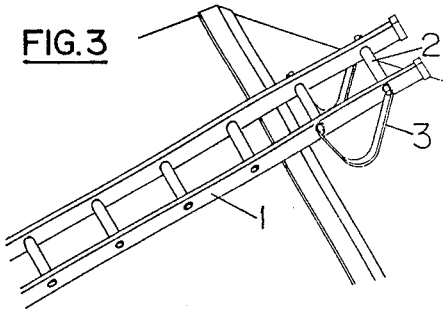
FIG. 3 is a perspective view of the ladder showing my invention in place over the roof peak and allowing the ladders to become part of a scaffold.
Figure 4:
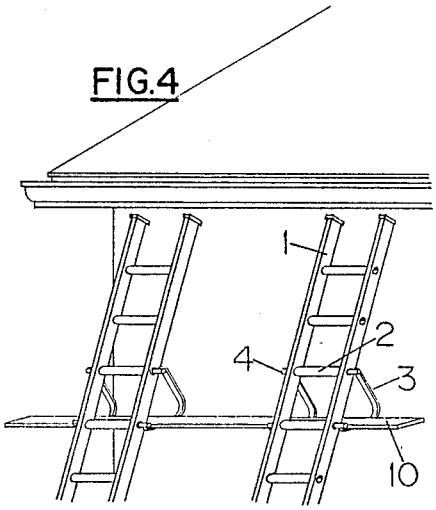
FIGS. 4 and 5 are a perspective view of two folding ladders with my invention in place supporting a plank allowing these folding ladders to become part of a scaffold.
Figure 5:
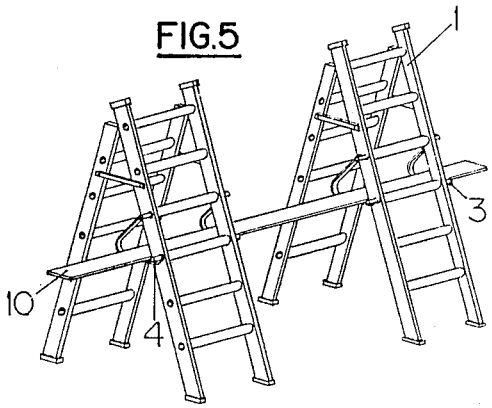

Detachably connected with any of the ladder having a metal tubing 7 welded at a right angle to each and of the bar 5. The metal tubing 7 having a diameter less that the insider diameter of the hollow rungs 2. The brackets 3 and 4 are mirror image of each other.

The length 8 of one leg of the flat bar 5 differs from the length 9 of the other leg to allow for various use of the device.

The distance "d" between the metal tubing 7 or each bracket is greater than the distance between a pair of adjacent hollow rungs 2.

The problem with designing an attachment of this nature is designing it free of moving parts to fit all ladders with hollow rungs while performing all the embodiments depicted by the accompanying illustrations. The present invention does, however, perform all the embodiments illustrated herein.

In operation the attendant will grasp each of the two pieces of the attachment at the welded ends and spring them slightly. This will allow for a snug fit of the metal tubing into each opposite ends of a pair of hollow rung of the ladder at the desired location.

As well be apparent to persons skilled in the art, various modifications and adaptions of the structure above-described are possible without departure from the spirit of the invention. The scope of which is defined in the appended claims.

The embodiments of the invention in which an exclusive property or privilege is claimed are defined as follows:

1. A bracket attachment for a ladder having a plurality of spaced hollow rungs, said bracket attachment having a flat metal bar bended at an acute angle, a pair of metal tubes, each one of said metal tubes being attached at one end to each end of said flat metal bar, the other end of said metal tubes extending a distance from an edge of said flat metal bar, the opposite distance between each metal tube being greater than the distance between a pair of adjacent hollow rungs whereby upon compression of each end of said flat metal bar toward each other, the metal tubes could be inserted into the hollow rungs of the ladder with a spring action providing a positive locking of said bracket within the ladder rungs and without the use of any other fastening means.

* * * * *